United States Patent [19]

Ielmini

[11] Patent Number: 4,915,292

[45] Date of Patent: Apr. 10, 1990

[54] END FILL CARTON

[75] Inventor: Angelo Ielmini, Patterson, Calif.

[73] Assignee: Del Puerto Marketing, Patterson, Calif.

[21] Appl. No.: 275,258

[22] Filed: Nov. 23, 1988

[51] Int. Cl.[4] ..... B65D 5/40; B65D 5/20

[52] U.S. Cl. ..... 229/132; 206/611; 229/3.1; 229/154

[58] Field of Search ..... 229/132, 133, 137, 3.1, 229/143, 145, 154; 206/607, 611, 625

[56] References Cited

U.S. PATENT DOCUMENTS

| | | | |
|---|---|---|---|
| 2,523,488 | 9/1950 | Williamson | 229/133 |
| 3,012,705 | 12/1961 | Thiolat | 229/186 |
| 3,094,265 | 6/1963 | Hovland | 229/133 |
| 3,098,599 | 7/1963 | Hagan | 229/132 |
| 3,146,933 | 9/1964 | Moore | 206/607 |
| 3,737,095 | 6/1973 | Derauf | 206/611 |
| 3,749,300 | 7/1973 | Jones | 229/132 |
| 4,657,177 | 4/1987 | Karabedian | 229/132 |
| 4,687,104 | 8/1987 | Ielmini | 206/607 |

FOREIGN PATENT DOCUMENTS

| | | | |
|---|---|---|---|
| 677037 | 12/1963 | Canada | 229/132 |
| 784801 | 10/1957 | United Kingdom | 229/132 |

*Primary Examiner*—Gary Elkins

*Attorney, Agent, or Firm*—Townsend & Townsend

[57] ABSTRACT

A microwave container (2) including a folded body forming a box having first, second, third and fourth sides (4, 26, 6, 28). The sides have first, second, third and fourth side edges, respectively, defining an end (14). A flap (10, 30, 32, 38) extends from each side and is attached at the edge of each side. A sealing region (34) is defined at the intersection of the first flap (10) and each of the adjacent flaps (30, 32) at the corners of the box formed by the first side (4). A notch (40) is formed between the first flap and each of the adjacent flaps before folding. A common seam (44) runs a chosen distance (43) from the corners (18, 20) such that when the first flap and the adjacent side flaps are folded, holes (36) normally formed at the corners are spaced therefrom. The remaining flap (38), opposite the first flap, is folded to cover and seal these holes.

6 Claims, 3 Drawing Sheets

END FILL CARTON

BACKGROUND OF THE INVENTION

This invention relates to cartons, particularly one-piece cartons, suitable for heating frozen foods in a microwave oven.

One-piece folded containers are well-known. For example, U.S. Pat. No. 4,687,104 to Ielmini has been developed by the inventor of the present application and is incorporated by reference herein. As is typical of the prior art. Ielmini is filled from its top during production. The rectangular top is sized to overlie the bottom, and extends from an outer edge of one of the sides. After filling the bottom portion of the container with a product, the top is sealed over the bottom. Top flaps formed integrally with the top are folded over and sealed against adjacent sides.

Currently, one-piece folded containers are often formed with web corners for providing a waterproof container. These web corners require that the containers be filled from the top and be top sealed. Although the resulting carton works well, it has several drawbacks when compared with conventional end filled cartons. The top filling process is much slower than the end filling process. In addition, top-fill carton equipment and systems are considerably more expensive than end-fill equipment, as much as 50% more costly.

Even though end filled cartons have several advantages over top filled cartons, they also have several drawbacks. With conventional end filled containers, small holes are formed at each of the corners where the flaps are folded over and sealed. These small holes remaining with conventional end filled containers can cause dehydration of the contents of the containers. The final flap which is folded is heat sealed along an approximately one-eighth inch section at its outermost edge, away from the fold. Although the small holes are covered by a flap and heat sealed, the resulting container is not waterproof and, thus, usually is not suitable for use in a microwave.

Generally, end filling is preferable to top filling because of its much faster line speed and lower costs. Until now, however, end filling has been impractical for one-piece folded body containers in which dehydration and leakage are concerns.

SUMMARY OF THE INVENTION

The present invention is a one-piece folded body container which is suitable for microwave use and yet can be end filled. The container has a first, typically, bottom surface which includes a first periphery having a first edge along one side of the periphery and first and second corners at opposite ends of the edge. The first surface has an adjoining side surface with an edge adjacent the edge of the first surface. The first surface and the side surface meet along a fold line oriented perpendicular to the edges of the first and side surfaces. The edge of the first surface and the edge of the side surface are aligned and intersect along the fold line. The edge of the first surface and the edge of the side surface each include a flap. These flaps intersect at a sealing region in the area at least of one of the corners.

The sealing region formed between the side flap and the flap of the first surface preferably forms a notch. The notch extends to a notch position a chosen distance from the corner. A covering flap extends from a second surface, the second surface being opposite the first surface. The covering flap is folded over the remaining flaps, including the sealing region, and sealed to them so to seal small holes formed near the intersection of the flaps of the first and side surfaces. Since the small holes are spaced from the corners and angled toward the covering flap, the sealing effectiveness of the covering flap is enhanced.

There are three seals ensuring a leakproof, watertight container. A first seal is formed by the overlap between the flaps of the first and side surfaces. A second eal is formed by a seam extending from the corner of the container a sufficient distance between the flaps. A third seal is formed by sealing the covering flap over the first two seals.

The folding sequence preferably proceeds as follows. The first flap, attached to the bottom surface, is preferably folded inwardly first, before the remaining flaps. The side flaps are then folded over the first flap. The first flap serves as a support for the side flaps. The covering flap is folded over the side flaps and the first flap. When the side flaps are folded over the first flap, each side flap is heat sealed to the first flap along an overlapping edge. This forms a waterproof bottom and side portion of the container. A second seal is formed by heat sealing the entire covering flap (approximately 90–95%) over the sealed first flap and side flaps. A third system for waterproofing the container is provided by displacing the small holes from the corners, upwardly away from the folds of the flaps.

By sealing the small holes, the one-piece folded container of the present invention is waterproof at its corners and prevents the dehydration which normally occurs in conventional containers. The contents retain their freshness during storage and when prepared in the containers of the present invention, resulting in, for example, "plump" and juicy vegetables.

The one-piece folded container of the present invention is leak-proof, microwaveable, and prevents dehydration of the contents of the container. This container may be end-filled, considerably increasing the line speed and reducing costs as compared to top-filled containers. Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
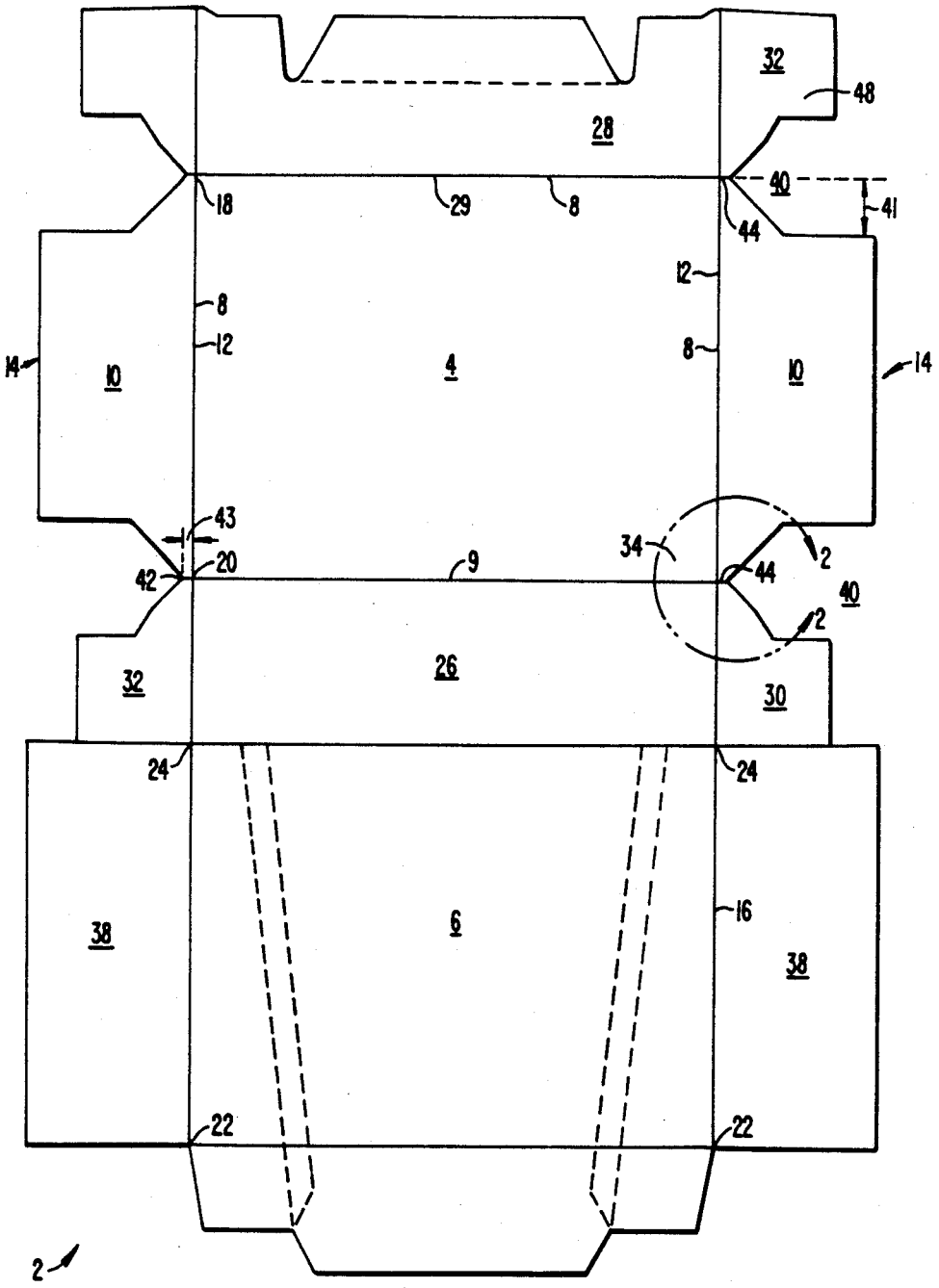
FIG. 1 shows an unfolded, flat carton of the present invention.

Referring now to the drawings, FIG. 1 illustrates the unfolded carton 2 constructed according to the present invention. Carton 2 includes, broadly, a first, bottom surface 4 and a second, top surface 6. When assembled, see FIG. 6, carton 2 may be used to contain a product such as food, typically frozen, for direct heating and cooking in a microwave oven.

First surface 4 is circumscribed by bottom periphery 8. Periphery 8 is rectangular is shape and extends around the entire outer edge of first surface 4. Periphery 8 includes four edges: a pair of opposite parallel edges 12, 12, joined by edge 29 and fold 9. Adjacent side flaps 10 extend from opposite edges 12 of bottom periphery 8. First and second corners 18, 20 are spaced apart at opposite ends of each edge 12.

Figure 6:
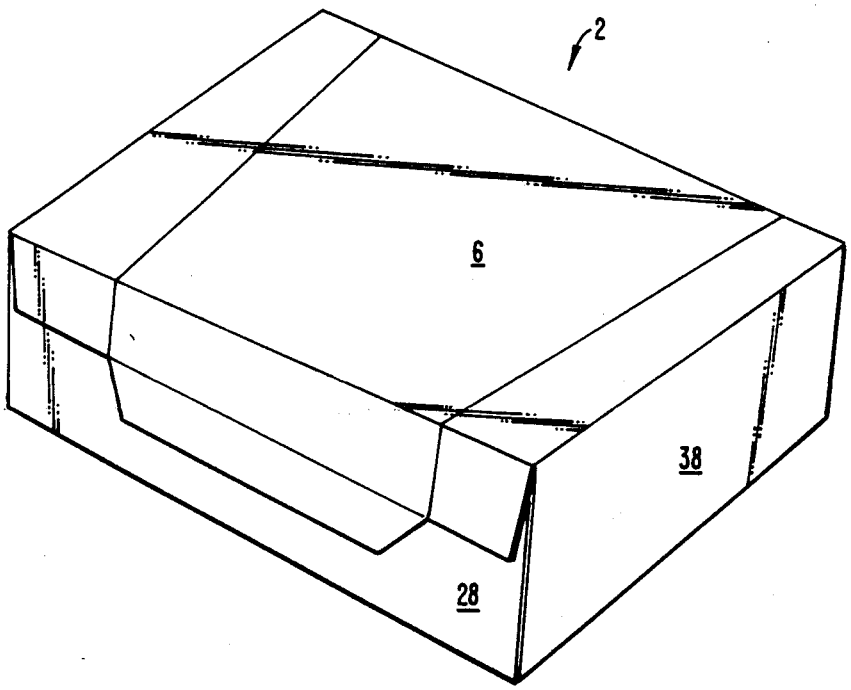
FIG. 6 is a perspective view of the folded container of the present invention.

Second surface 6 is parallel to and spaced from first surface 4 when carton 2 is assembled as shown in FIG. 6. Second surface 6 includes a second edge 16 including third and fourth corners 22, 24 opposite first and second corners 18, 20, respectively. A side 26 extends between second and fourth corners 20, 24. A side flap 28 extends from the edge 29 of periphery 8 opposite side 26. Side 26 includes side flaps 30, 32 at either end. Side flaps 30, 32 intersect first flaps 10 at sealing regions 34.

For ease of reference, a single end 14 of carton 2 will be hereinafter described. Although reference is made to only one end 14, it is to be understood that opposite ends 14 of carton 2 are identical.

Figure 3:
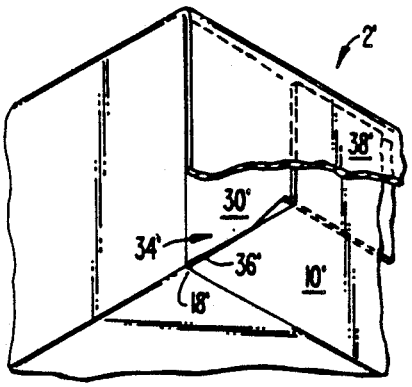
FIG. 3. PRIOR ART
FIG. 3 is an enlarged view of a corner of the folded carton of the prior art.
Figure 4:
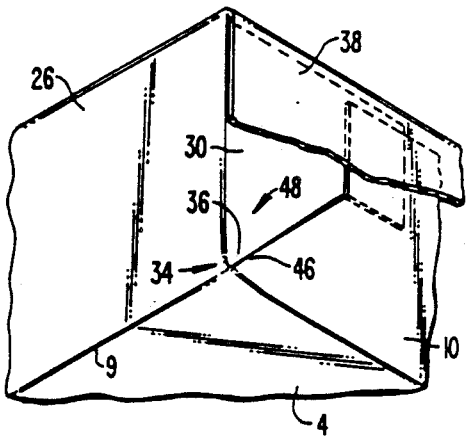
FIG. 4 is an enlarged view of a corner of the folded carton of the present invention.

A corner of a conventional carton 2' is seen in FIG. 3. Side flaps 30' intersect first flap 10', at corner 18'. A hole 36' is formed in corner 18' of region 34'. A covering flap 38' extends from a top surface (not shown) of carton 2' of FIG. 3 for sealing the contents of the carton. Holes 36', formed at the corners 18', are not completely sealed by covering flap 38'. This results in the above-mentioned dehydration and leakage problems.

Figure 2:
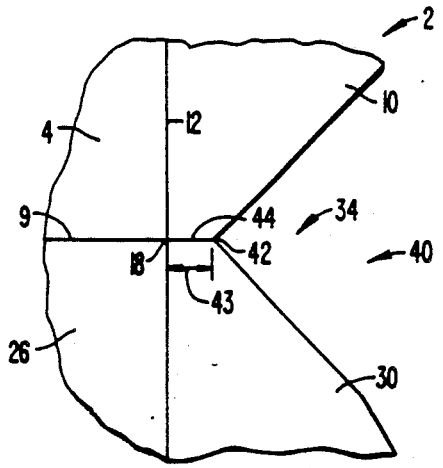
FIG. 2 is an enlarge view of a corner of the carton of FIG. 1 taken along line 2—2.

As seen in FIGS. 1 and 2, carton 2 of the present invention has a notch 40 formed in sealing region 34 between first flap 10 and side flap 30. Sealing region 34 defines a point of intersection at a notch position 42 a chosen distance 43 from corner 18 before folding. A seam 44 extends from bottom corner 18 to notch position 42. Prior to folding of first flap 10 and side flap 30, seam 44 runs in line with the fold 9 of carton 2 between bottom 4 and side 26.

Seam 44 extends from corner 18 distance 43 (approximately 1/32 of an inch, exaggerated in the figures for sake of illustration) to notch position 42. When first flap 10 and side flaps 30 are folded, a small hole 36 is formed in the vicinity of corners 18, 20. Holes 36 are spaced away from bottom corners 18 by about distance 43. Holes 36 are oriented such that they are angled toward the center of end 14, sealing the corner. An additional seal is provided by a covering flap 38.

Covering flap 38 extends from second surface 6 and is folded over side flaps 30, 32, first flap 10, and small holes 36, as described below.

In use, carton 2 is folded and sealed such that side 28 joins first surface 4 and second surface 6. End 14 includes first flap 10, side flaps 30, and covering flap 38 extending from respective sides of the box as formed by folded carton 2. At at least one end 14, notches 40 are formed between first flap 10 and side flaps 30, 32. First flap 10 is first folded inwardly to close end 14. Cutouts 41 are formed by one-half of notches 40 on both sides of first flap 10 when only the first flap is folded (see FIG. 1). Side flaps 30, 32 are then folded over first flap 10, supported by the first flap, to close cutouts 41 formed by notches 40. This forms a first seal creating a substantially watertight container. Holes 36 are spaced away from their respective corners, and angled inwardly toward the interior of carton 2, establishing an additional seal in the creation of the watertight container. Covering flap 38 is then folded over first flap 10 and side flaps 30, 32 to seal end 14, including holes 36, creating a third seal for the leakproof, microwaveable container.

Figure 5:
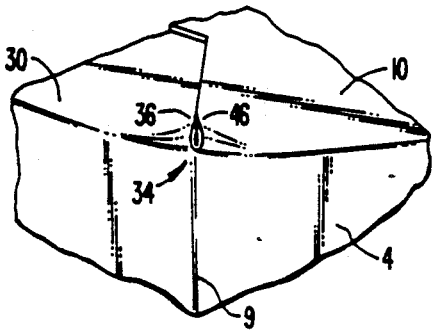
FIG. 5 is an enlarged perspective view of a corner of the folded carton as seen from a side, illustrating the sealing region of the corner.

As flaps 10, 30 and 32 are folded, the material surrounding seam 44 does not fold smoothly. Rather, the extension of seam 44 creates an apex 46 formed slightly above corner 18 (see FIG. 5). Due to distance 43, hole 36 is spaced away from corner 18 and directed toward covering flap 38. This distance is great enough to space hole 36 from the corners, while being small enough to avoid excessive interference with heat sealing of covering flap 38. Covering flap 38 is folded over first flap 10, side flaps 30, 32 and apex 46. Side flaps 30, 32 are heat sealed at approximately heat seal point 48 when carton 2 is closed, thereby creating the first seal. Covering flap 38 is heat sealed along an area of up to 95% of its surface closest to the edge of the covering flap. This provides a second seal in establishing a leakproof, watertight container. Covering flap 38 covers holes 36, thereby forming a waterproof corner, with the contents of carton 2 protected from dehydration at those corners.

Modification and variation can be made to the disclosed embodiment without departing from the subject matter of the invention as defined by the following claims. For example, each of the three seals is, independently, an improvement over the conventional end-fill containers and could be employed alone to improve sealing effects.

What is claimed is:

1. An improved microwave container of the type including a foldable body for forming a box having an opening at an end of the box, the foldable body having a first surface and an adjoining side surface, each surface defining at least one corner, a first flap extending from an edge of the first surface along a first fold and a side flap extending from an edge of the side surface adjacent to the first flap along a second fold, a hold formed at the corners when the flaps are folded, said flaps closing opening of the box, a second surface parallel to and spaced from the first surface, and a covering flap extending from the second surface, wherein the improvement comprises:

a common seam delineated in line with the folds of the box defined by an overlap of the first flap and the side flap to form a first seal, said seam connecting the corner and hole by joining the first flap and the side flap together for a slight distance such that the hole is spaced from the corner when the box is folded to form a second seal, said seam, first flap, side flap and corner together defining a sealing region; and the covering flap substantially covering the hole to provide a third seal.

2. The container as defined by claim 1 wherein the sealing region defined a point of intersection of the first flap and side flap to create a notch between the first flap and side flap before folding, wherein the point of intersection is disposed said slight distance from the corners such that the covering flap substantially covers the first flap and the side flap when the first flap and side flap are folded.

3. The container as defined by claim 1 further including an apex formed at an end of said seam extending above its respective corner.

4. The container as defined by claim 1 wherein the side flap overlies the first flap when the flaps are folded.

5. The container as defined by claim 1 wherein the first surface comprises a bottom surface and the second surface comprises a top surface.

6. The container as defined by claim 1 wherein a notch is formed between the first flap and the side flap, the notch extending to a notch position said slight distance from the corners such that the covering flap substantially covers the first flap and the side flap when the first flap and side flap are folded.

* * * * *